US006591498B2

(12) United States Patent
Irie et al.

(10) Patent No.: US 6,591,498 B2
(45) Date of Patent: Jul. 15, 2003

(54) METHOD OF PRODUCING A CATALYTIC CONVERTER

(75) Inventors: Tohru Irie, Nagoya (JP); Masashi Ota, Kariya (JP)

(73) Assignee: Sango Co., Ltd., Nagoya (JP)

( * ) Notice: Subject to any disclaimer, the term of this patent is extended or adjusted under 35 U.S.C. 154(b) by 0 days.

(21) Appl. No.: 10/102,920

(22) Filed: Mar. 22, 2002

(65) Prior Publication Data

US 2002/0095787 A1 Jul. 25, 2002

Related U.S. Application Data

(63) Continuation-in-part of application No. 09/629,164, filed on Jul. 31, 2000, now Pat. No. 6,381,843.

(30) Foreign Application Priority Data

Aug. 3, 1999 (JP) ..... 11-220540

(51) Int. Cl.[7] ..... B23P 15/00
(52) U.S. Cl. ..... 29/890; 29/515
(58) Field of Search ..... 29/890, 515, 516, 29/505, 508, 510, 511, 517, 518, 506; 72/84, 85, 112; 422/180, 188

(56) References Cited

U.S. PATENT DOCUMENTS

| | | | | | |
|---|---|---|---|---|---|
| 2,882,851 | A | * | 4/1959 | Graves | 72/85 |
| 3,689,111 | A | * | 9/1972 | Osmun et al. | 285/39 |
| 3,792,603 | A | * | 2/1974 | Orain | 72/402 |
| 4,969,264 | A | * | 11/1990 | Dryer et al. | 29/890 |
| 5,104,627 | A | * | 4/1992 | Usui et al. | 422/171 |
| 5,329,698 | A | | 7/1994 | Abbott | 29/890 |
| 5,937,516 | A | * | 8/1999 | De Sousa et al. | 29/890 |
| 5,953,817 | A | * | 9/1999 | Watanabe et al. | 29/890 |
| 5,980,837 | A | | 11/1999 | Umin et al. | 422/179 |
| 6,216,512 | B1 | | 4/2001 | Irie | 72/121 |
| 6,233,993 | B1 | | 5/2001 | Irie | 72/121 |

FOREIGN PATENT DOCUMENTS

| | | | |
|---|---|---|---|
| JP | 58-084619 | 5/1983 | |
| JP | 59-092123 | 5/1984 | 72/85 |
| JP | 11-336537 | 12/1999 | |
| JP | 2000-263161 | 9/2000 | |

* cited by examiner

*Primary Examiner*—I. Cuda Rosenbaum
(74) *Attorney, Agent, or Firm*—Oliff & Berridge, PLC

(57) ABSTRACT

The present invention is directed to a method of producing a catalytic converter which comprises the steps of providing a shock absorbent member around an outer periphery of a catalyst substrate, inserting the catalyst substrate and the shock absorbent member into a cylindrical workpiece, fixing the cylindrical workpiece to prevent the cylindrical workpiece from being rotated about a longitudinal axis thereof, reducing a diameter of a body portion of the cylindrical workpiece covering at least a portion of the shock absorbent member to hold the catalyst substrate in the cylindrical workpiece, spinning at least an end portion of the cylindrical workpiece, by means of a plurality of spinning rollers, which are evenly positioned around the outer periphery of the end portion, and which are revolved about the axis of the end portion along a common circular locus, and moved in a radial direction of the end portion, and moving the plurality of spinning rollers in an axial direction of the end portion to reduce a diameter of the end portion along the axis thereof, and thereby form a neck portion of the cylindrical workpiece.

13 Claims, 6 Drawing Sheets

METHOD OF PRODUCING A CATALYTIC CONVERTER

This is a Continuation-in-Part of application Ser. No. 09/629,164 filed Jul. 31. 2000 now U.S. Pat. No. 6,381,843. The entire disclosure of the prior application(s) is hereby incorporated by reference herein in its entirety.

BACKGROUND OF THE INVENTION

1. Field of Invention

The present invention relates to a method of producing a catalytic converter, particularly the method of producing the catalytic converter with a catalyst substrate held in a cylindrical housing through a shock absorbent member.

2. Description of Related Arts

In order to produce catalytic converters mounted on recent vehicles, generally employed is such a method for rolling a ceramic mat around a catalyst substrate to form a shock absorbent member, and pressing the shock absorbent mat into a casing, or cylindrical housing. On one hand, the shock absorbent mat is required to be made thick and soft to provide its shock absorbing function, on the other hand, the shock absorbent mat is required to be made thin and hard to press it into the casing easily. In order to meet those requirements contradictory to each other, the shock absorbent mat has to be made to reach a compromise between them.

According to the prior method, therefore, it has been pointed out that the catalyst substrate could not be protected by the shock absorbent mat sufficiently, to deteriorate the substrate, or that the catalyst substrate and the shock absorbent mat were damaged when they were pressed into the casing. In order to solve those problems, it has been proposed that after the catalyst substrate and the shock absorbent mat were inserted into the cylindrical housing, the housing is compressed so as to compress the shock absorbent mat by a certain amount, as disclosed in publications such as U.S. Pat. No. 5,329,698, Japanese Patent Laid-open Publication Nos. 64-60711, 9-234377, 9-170424 and so on.

With respect to the cylindrical housing for holding the catalyst substrate therein, it has been proposed in Japanese Utility-model Laid-open Publication No. 61-110823 that in order to overcome inconvenience in a prior method for welding a casing body with cone portions at its opposite ends, a tubular member or pipe is increased or decreased in diameter to form the casing body and at least one of the cone portions in a body, thereby to produce a case for holding the catalyst substrate. In this Publication, it is disclosed that one end portion of the tubular member having the same diameter as that of the casing body is reduced in diameter to form a cone portion and a guide pipe integrally, and the catalyst substrate and cushion member are inserted into a cylindrical portion of the casing body, and then an open end portion of the case except for the casing body is reduced in diameter by a spinning process to integrate it with the other cone portion and the guide pipe. However, the Publication is silent about the spinning process, nor a possibility for applying the spinning process to the casing body.

Also, Japanese Patent Laid-open Publication No. 9-112259 discloses a prior method of producing a monolithic catalyst converter by welding flanges of an upper member and a lower member, with a monolithic catalyst held between the upper member and lower member, and another prior method for welding a cylindrical portion with cone portions at its opposite ends. In order to overcome inconvenience in assembling parts according to the prior methods, the Publication proposes such a method of producing a monolithic catalyst converter that has an inserting process for inserting the monolithic catalyst into a cylindrical pipe member, and a drawing process for drawing opposite open ends of the pipe member to form them into a funnel shape respectively. It is disclosed in the publication that the drawing process is performed by a drawing apparatus with dies, or a spinning drawing apparatus, which is shown in FIG. 9 of the Publication, and which is explained that a roller is pressed onto one opening end of the pipe member, with the pipe member being rotated about its axis. In FIG. 6 of the Publication, there is disclosed such a method that after the process for inserting the monolithic catalyst and the drawing process were performed, a pressing jig having rollers is pressed onto the pipe member to form ring-shaped recesses on its cylindrical portion.

In the methods of producing the catalytic converters as disclosed in the above-described Japanese Publication Nos. 61-110823 and 9-112259, the drawing process is performed by the spinning process, which has not been explained practically in the Publication No. 61-110823, but which has been disclosed in FIG. 9 of the Publication No. 9-112259. That is, it is apparent from the Publication No. 9-112259 that the spinning process is a known process, in which a single roller is pressed onto one opening end of the pipe member, with the pipe member being rotated about its axis, and which had been generally used as an embodiment of the drawing process. Otherwise, any process different from the general process should have been explained in the Publications. For example, Japanese Patent Laid-open Publication No. 3-146232, which relates to a technical field entirely different from the catalytic converter, discloses a method for processing an end portion of a tubular member having grooves formed therein, wherein a forming roll is pressed onto an end portion of a grooved pipe material formed inside surface thereof with grooves in the longitudinal direction, and rotated by a rotating mechanism, and the end portion of the tubular member is drawn to be decreased in diameter, with the forming roll revolved and freely rotated in accordance with rotation of the rotating mechanism, and moved in a radial direction. In that method, the single forming roll has been employed, as in the prior method.

According to the methods as described above, wherein after the catalyst substrate was inserted into the tubular member or cylindrical member and then a diameter of the cylindrical member was reduced, it is difficult to form a neck portion on at least an end portion of the cylindrical member, to be smoothly integrated with the reduced diameter portion of the cylindrical member.

SUMMARY OF THE INVENTION

Accordingly, it is an object of the present invention to provide a method of producing a catalytic converter with a catalyst substrate held in a cylindrical housing through a shock absorbent member, and with at least an end portion of the cylindrical housing smoothly integrated with a body portion of the cylindrical housing for holding the catalyst substrate.

In accomplishing the above and other objects, the method of producing the catalytic converter may comprise providing a shock absorbent member around an outer periphery of a catalyst substrate, inserting the catalyst substrate and the shock absorbent member into a cylindrical workpiece, reducing a diameter of a body portion of the cylindrical workpiece covering at least a portion of the shock absorbent member to hold the catalyst substrate in the cylindrical workpiece, fixing the cylindrical workpiece to prevent the cylindrical workpiece from being rotated about a longitudinal axis thereof, spinning at least an end portion of the cylindrical workpiece, by means of a plurality of spinning rollers, which are evenly positioned around the outer periphery of the end portion, and which are revolved about the axis of the end portion along a common circular locus, and moved in a radial direction of the end portion, and moving the plurality of spinning rollers in an axial direction of the end portion to reduce a diameter of the end portion along the axis thereof, and thereby form a neck portion of the cylindrical workpiece.

In the method as described above, the spinning process is preferably made by three spinning rollers positioned with an equal distance spaced between neighboring rollers along the common circular locus.

In the method as described above, the spinning rollers may be revolved about the axis of the end portion of the cylindrical workpiece positioned in a predetermined relationship with a longitudinal axis of the body portion of the cylindrical workpiece.

In the method as described above, the spinning rollers may be moved to reduce a diameter of a stepped portion formed on the cylindrical workpiece after the diameter of the body portion was reduced, thereby to form the neck portion smoothly integrated with the body portion of the cylindrical workpiece.

Or, the spinning rollers may be moved to reduce a diameter of a stepped portion formed between the body portion and the neck portion, after the diameter of the body portion was reduced, thereby to remove the stepped portion from the cylindrical workpiece.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENTS

Figure 1:
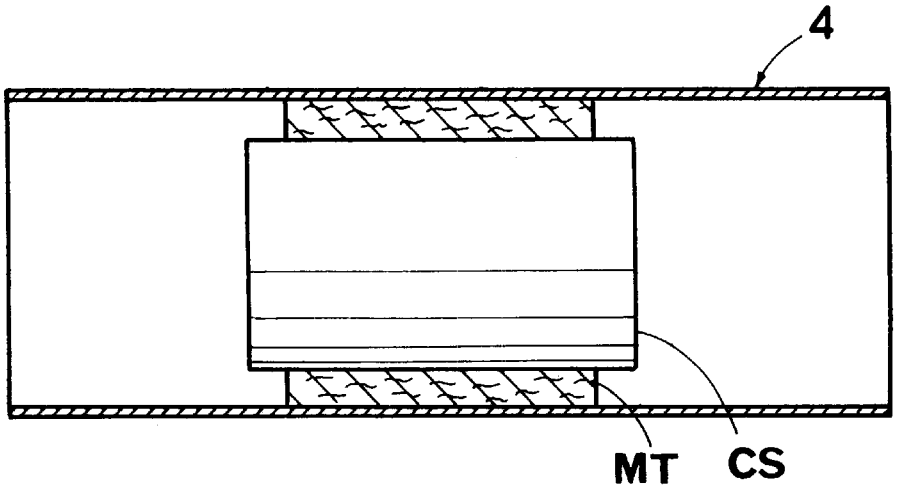
FIG. 1 is a side view sectioned in part of a catalytic converter, with a catalyst substrate and a shock absorbent mat wrapped around the substrate, received in a cylindrical housing, according to an embodiment of the present invention.

Referring to FIGS. 1–4, there is schematically illustrated a cylindrical housing with a catalyst substrate and a shock absorbent member received in a cylindrical housing, in each step for a method of producing a catalytic converter according to an embodiment of the present invention, respectively. At the outset, a shock absorbent mat (MT), which serves as the shock absorbent member of the present invention, is wrapped around a catalyst substrate (CS) as shown in FIG. 1, and fixed by an inflammable tape if necessary. Then, these are received in a cylindrical workpiece 4, which will be formed into a cylindrical housing 4 (indicated by the same numeral reference as that of the workpiece). In this case, the outer surface of the shock absorbent mat (MT) is not pressed onto the inner surface of the cylindrical workpiece 4, i. e., the former is not pressed into the latter, but the catalyst substrate (CS) and the shock absorbent mat (MT) are smoothly received in the cylindrical workpiece 4. At this step, therefore, the catalyst substrate (CS) and the shock absorbent mat (MT) are not damaged. According to the present embodiment, the catalyst substrate (CS) is made of ceramics, while it may be made of metal. The cylindrical workpiece 4 is a stainless steel tube, while it may be a tube made of other metals. According to the present embodiment, the shock absorbent mat (MT) is constituted by an alumina mat which will be hardly expanded by heat, but may be employed a vermiculite mat having a thermal expansion property, because any kinds of mats may be employed in the present invention.

Figure 2:
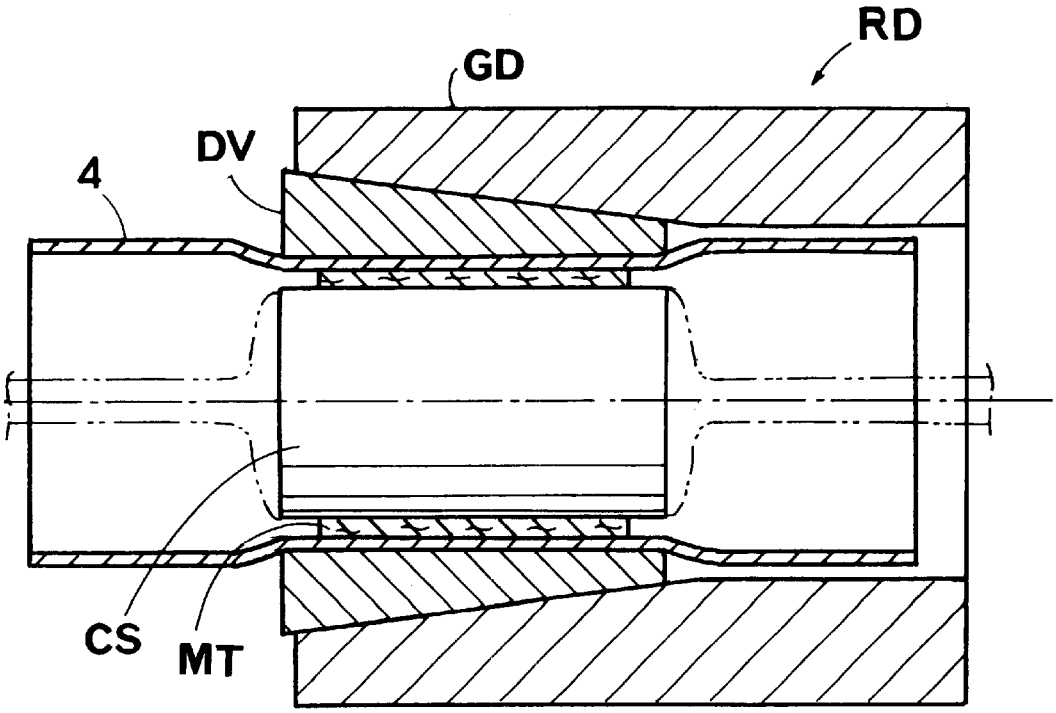
FIG. 2 is a side view sectioned in part of a catalytic converter, with a body portion of a cylindrical housing and a shock absorbent member reduced in diameter by means of a reducing diameter device having dies, according to an embodiment of the present invention.

Next, as shown in FIG. 2, a diameter of a body portion of the cylindrical workpiece 4 covering at least a portion of the shock absorbent mat (MT) is reduced by a reducing diameter device (RD), which is called as a finger type using a collet chuck, according to the present embodiment. As shown in FIG. 2, a plurality of forming dies (DV) each having a tapered outer surface, i. e., collets, are accommodated in a cylinder (GD) having a tapered inner surface. The dies (DV) are arranged to be slidable in the cylinder GD, which is moved along its longitudinal axis by means of a pressure controlled actuator (not shown), for example. In FIG. 2, two-dotted chain lines indicate pushers to hold the catalyst substrate (CS) and the shock absorbent mat (MT) within the cylindrical workpiece 4, when the diameter of the body portion of the cylindrical workpiece 4 is reduced.

Accordingly, when the cylinder (GD) is moved along its longitudinal axis in a direction to the left in FIG. 2, the dies (DV) are forced to move in a radial direction toward the longitudinal axis of the cylinder (GD), so that the diameter of the body portion of the cylindrical workpiece 4 is reduced. Consequently, the shock absorbent mat (MT) is reduced in diameter together with the cylindrical workpiece 4, so that the catalyst substrate (CS) is held in the cylindrical workpiece 4. The dies (DV) may be rotated about the longitudinal axis of the cylinder (GD) by a certain angle, every compressing cycle wherein they are moved in the radial direction by a predetermined amount, to reduce the diameter of the body portion of the cylindrical workpiece 4 uniformly around the periphery thereof.

Figure 3:
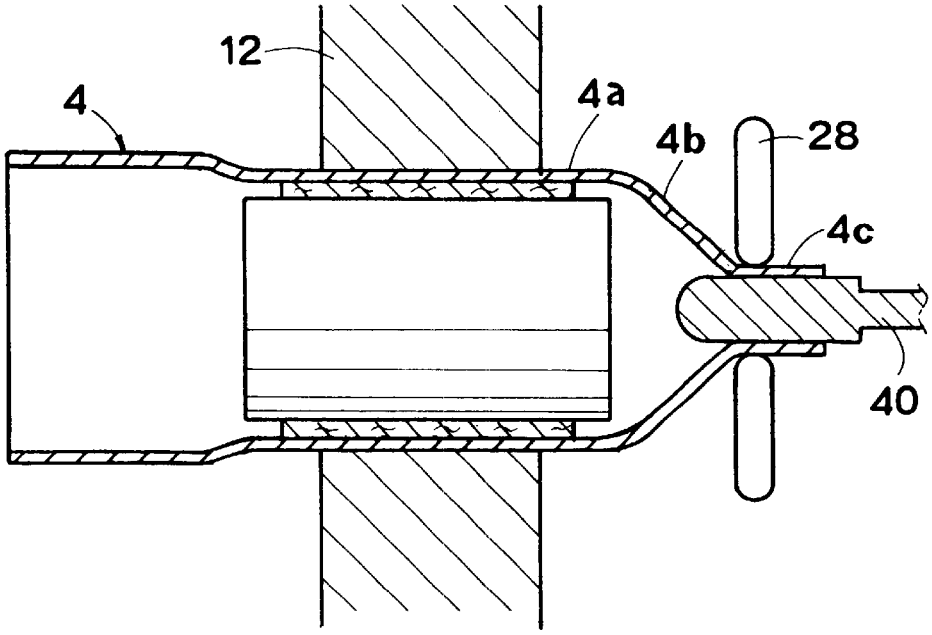
FIG. 3 is a side view sectioned in part of a catalytic converter, with one end potion of the cylindrical housing applied with a necking process by means of spinning rollers, according to an embodiment of the present invention.

Then, as shown in FIG. 3, the reduced diameter portion 4*a* of the cylindrical workpiece 4 is clamped by a clamp device 12 to be securely fixed not to be rotated, and not to be moved axially. Then, a spinning process is made to at least an end portion of the cylindrical workpiece 4, by means of a plurality of spinning rollers 28, which are revolved about the axis of the end portion of the cylindrical workpiece 4 along a common circular locus, and which will be described later. That is, a plurality of spinning rollers 28, which are positioned around the outer periphery of the end portion of the cylindrical workpiece 4, preferably with an equal distance spaced between the neighboring rollers, are pressed onto the outer surface of the end portion of the cylindrical workpiece 4, and revolved about the axis thereof, and moved along the axis (to the right in FIG. 3), with a revolutionary locus reduced gradually, to achieve the spinning process. Accordingly, one end portion of the cylindrical workpiece 4 is gradually reduced in diameter by the spinning rollers 28 to provide the tapered portion 4*b*, and the necking process is made with an axially movable mandrel 40, which will be described later, inserted into the one end portion of the cylindrical workpiece 4 to provide the bottle neck portion 4*c*.

Figure 4:
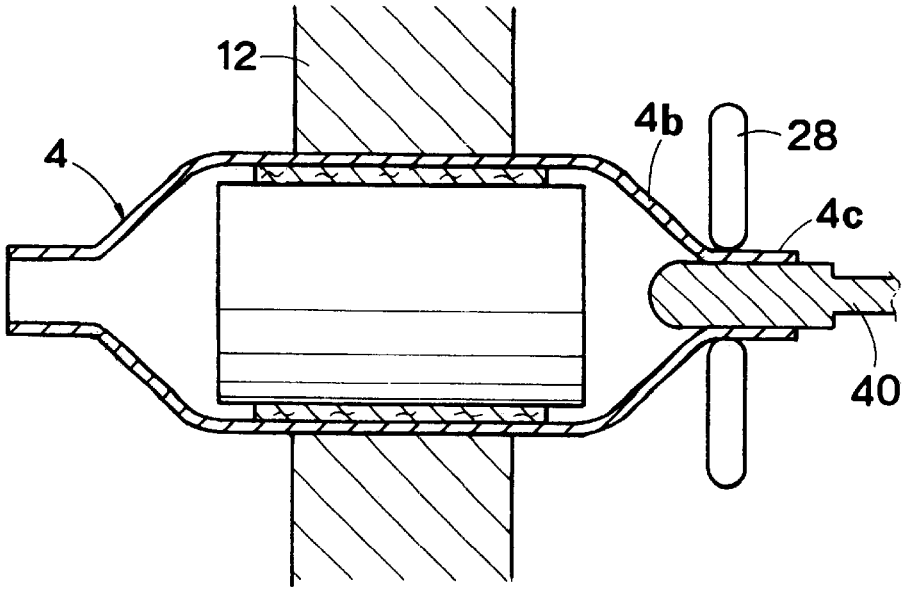
FIG. 4 is a side view sectioned in part of a catalytic converter, with the other one end potion of the cylindrical housing applied with a necking process by means of spinning rollers, according to an embodiment of the present invention.

Next, the cylindrical workpiece 4 is reversed by 180 degree, and positioned as shown in FIG. 4, so that the necking process is made by means of the spinning rollers 28, with respect to the other one end portion of the cylindrical workpiece 4, as well. The reversing operation of the cylindrical workpiece 4 is performed after the process as shown in FIG. 3, as follows. That is, the cylindrical workpiece 4 is released from the clamp device 12, and reversed by a robot hand (not shown), and then clamped again by the clamp device 12. The robot may be used for supplying workpieces such as the cylindrical workpiece 4 and transferring the same, to obtain a more efficient productivity. Thereafter, the body portion of the cylindrical workpiece 4 is clamed by the clamp device 12, and the other one end portion of the cylindrical workpiece 4 is formed by the spinning rollers 28 to form the tapered portion 4*b* and the bottle neck portion 4*c*.

As shown in FIGS. 3 and 4, when the necking process is performed by the spinning rollers 28, with the axially movable mandrel 40 inserted into the open end of the cylindrical workpiece 4, accuracy of shape of the bottle neck portion 4*c* can be improved. Instead, the bottle neck portion 4*c* may be formed on one end portion of the cylindrical workpiece 4 at first, by the spinning rollers 28 for example, and then the reduced diameter portion 4*a* may be formed by the reducing diameter device (RD), and finally the necking process may be performed to the other one end portion of the cylindrical workpiece 4.

Figure 5:
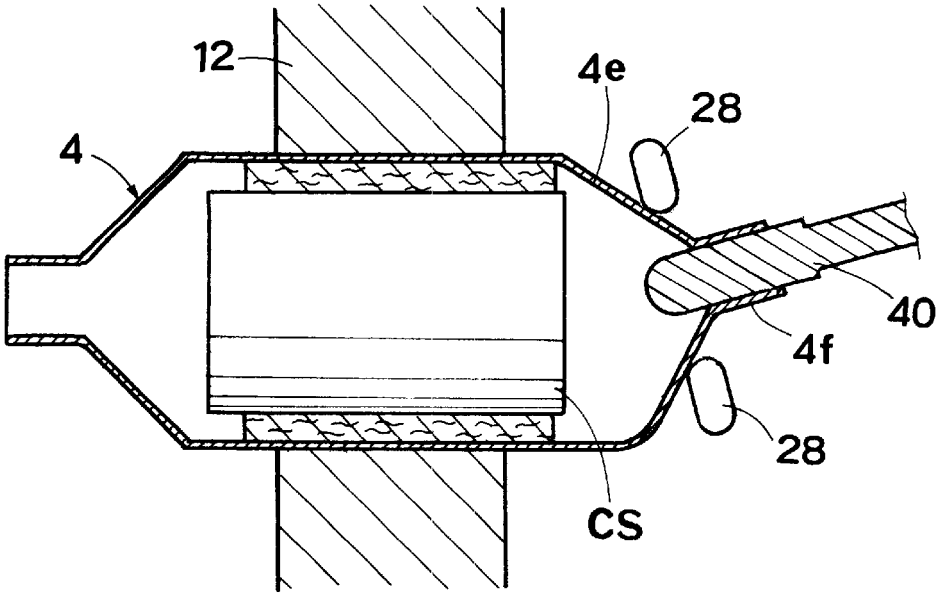
FIG. 5 is a side view sectioned in part of a catalytic converter, with the other one end potion of the cylindrical housing applied with a necking process by means of spinning rollers about an oblique axis, according to another embodiment of the present invention.

FIG. 5 illustrates another embodiment of the present invention, wherein the process as shown in FIG. 5 is performed instead of the process as shown in FIG. 3, after the processes as shown in FIGS. 2 and 3 were performed. In FIG. 5, the mandrel 40 is positioned in such a manner that its axis is oblique to the axis of the cylindrical workpiece 4, to which the necking process is performed by the spinning rollers 28. Consequently, the tapered portion 4*e* and the bottle neck portion 4*f* having the oblique axis to the axis of the reduced diameter portion 4*a* can be formed. Or, there may be formed the tapered portion 4*e* and the bottle neck portion 4*f* having an offset axis from the axis of the reduced diameter portion 4*a*, while the figure is omitted herein. Furthermore, the necking process to the opposite ends of the cylindrical workpiece 4 can be performed, in accordance with a combination of axes coaxial with, oblique to, and offset from the axis of the reduced diameter portion 4*a*. The spinning processes performed along the offset axis and oblique axis are disclosed in Japanese Patent Laid-open Publication Nos. 11-147138 and 11-151535 (corresponding to the U.S. Pat. Nos. 6,018,972 and 6,067,833), and also in the U.S. Pat. Nos. 6,216,512B1 and 6,233,993B1, and those processes can be used to form the end portion of the cylindrical workpiece 4.

Figure 7:
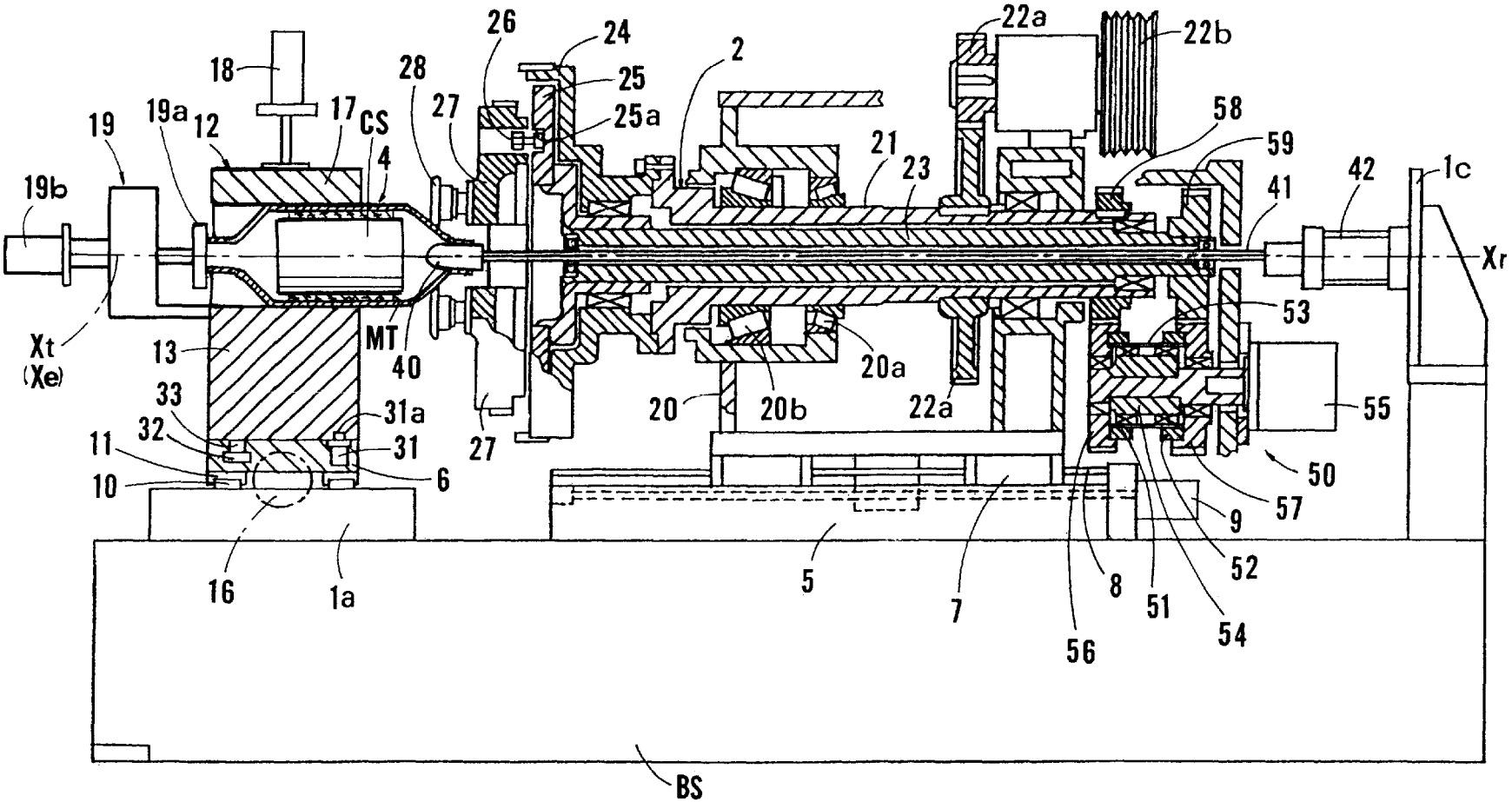
FIG. 7 is a side view of a spinning apparatus with a portion thereof sectioned, for use in an embodiment of the present invention.
Figure 8:
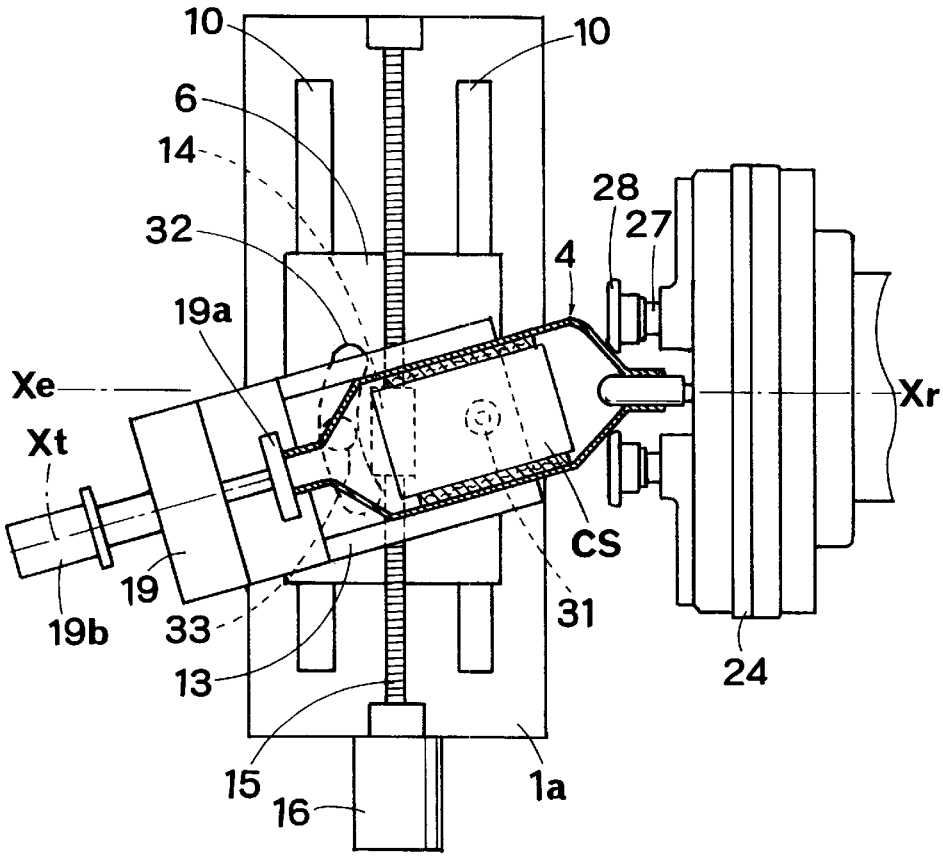
FIG. 8 is a plan view of a part of a spinning apparatus with a portion thereof sectioned, for use in an embodiment of the present invention.
Figure 9:
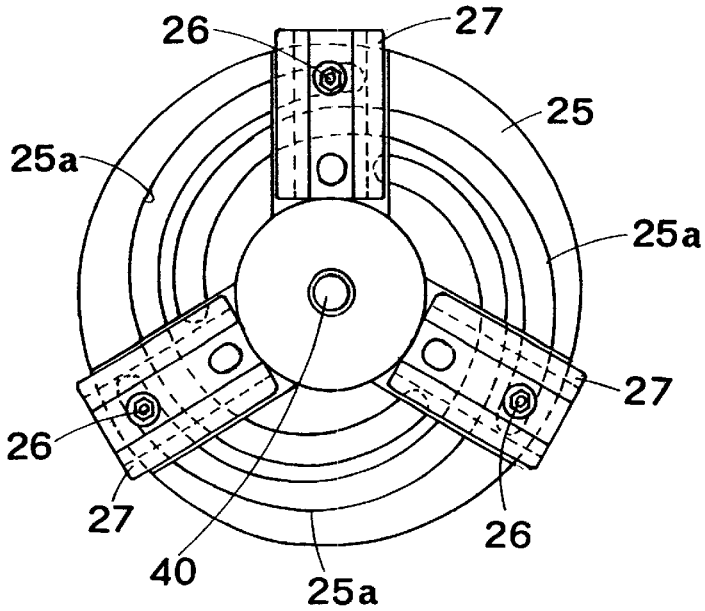
FIG. 9 is a front view showing a cam plate and support members of a spinning apparatus for use in an embodiment of the present invention.

In FIGS. 7–9, there is shown the spinning apparatus for use in producing the catalytic converters as described above. Among them, FIG. 8 shows the apparatus for performing the necking process as shown in FIG. 5. In FIGS. 7 and 8, a forming target central axis Xe of one end portion of the cylindrical workpiece 4 is employed as a X-axis of the apparatus, while a central axis of the other one end portion of the cylindrical workpiece 4 is aligned with the central axis Xt, because they are on the same plane in FIG. 7. In parallel with the X-axis, a pair of X-axis guide rails 5 are secured to one side (right side in FIG. 7) on a base BS. A case 20 is arranged to be movable along the X-axis guide rails 5. The case 20 has a ball socket 7 which is secured under the case 20, and which is engaged with a spline shaft 8. This shaft 8 is mounted on the base BS in parallel with the X-axis guide rails 5, to be rotated by a servo motor 9. Accordingly, when the spline shaft 8 is rotated by the servo motor 9, the case 20 is moved along the X-axis. On the other hand, a bed 1*a* is formed on the other side (left side in FIG. 7) of the base BS. Secured to the bed 1*a* are a pair of Y-axis guide rails 10, on which a pair of sliders 11 for supporting a sliding table 6 are movably mounted, and a clamp device 12 is mounted on the table 6. The clamp device 12 includes a lower clamp 13 rotatably mounted on the table 6, and an upper clamp 17 arranged upward of the lower clamp 13, to clamp the cylindrical workpiece 4 between the lower clamp 13 and upper clamp 17. The table 6 has a ball socket 14 (as shown in FIG. 8) secured thereunder, which is engaged with a spline shaft 15. This shaft 15 is mounted on the bed 1*a* in parallel with the Y-axis guide rails 10, to be rotated by a servo motor 16. When the spline shaft 15 is rotated by the motor 16, the table 6 and clamp device 12 are moved along the Y-axis.

Above the clamp device 17, an actuator 18, which is activated by oil pressure, for example, is arranged to support the upper clamp 17 and drive it vertically. When the cylindrical workpiece 4 is set on or removed from the clamp device 12, the upper clamp 17 is lifted by the actuator 18 upward. A clamp face of a half cylinder configuration is formed on the upper surface of the lower clamp 13, and a clamp face of a half cylinder configuration is formed on the lower surface of the upper clamp 17. Therefore, when the cylindrical workpiece 4 is clamped between the clamp faces, it is secured not to be rotated or moved. On the clamp device 12, a positioning device 19 is disposed at the opposite side to the case 20, so that the cylindrical workpiece 4 is positioned so as to abut on a stopper 19*a* of the positioning device 19. The positioning device 19 is secured to the lower clamp 13, so as to be moved together with the clamp device 12. The stopper 19*a* of the positioning device 19 is supported by a cylinder 19*b* to be moved in the axial direction, so that the stopper 19*a* can be positioned along the X-axis relative to the lower clamp 13. Therefore, positioning of the cylindrical workpiece 4 along its longitudinal axis can be made properly and easily.

Accordingly, when the cylindrical workpiece 4 is set on the clamp face of the lower clamp 13, with the one end portion of the cylindrical workpiece 4 abutted on the stopper 19*a*, and then the upper clamp 17 is actuated to move downward by the actuator 18, the body portion of the cylindrical workpiece 4 is clamped at a predetermined position between the lower clamp 13 and upper clamp 17. In this case, the cylindrical workpiece 4 is positioned such that its central axis Xt is located on the same plane as the plane where the longitudinal central axis Xr of a main shaft 21, which will be described later, is located in parallel with the base BS, i. e., on the same height from the base BS as the height of the central axis Xr from the base BS.

A rotating device such as a motor 31 is embedded in the table 6 at the left side in FIG. 7, and an output shaft 31*a* of the motor 31 extends upward in FIG. 1, or vertically to the base BS, to be engaged with the lower clamp 13, which is rotated about the shaft 31*a*. On the upper surface of the table 6, there is formed a guide groove 32 which has a circular configuration with its center located on the shaft 31*a*, and into which a guide roller 33 is fitted. The guide roller 33 is rotatably mounted on the lower clamp 13, so that the lower clamp 13 is guided by the groove 32 to be rotated about the shaft 31*a*. FIG. 8 illustrates such a state that the lower clamp 13 is rotated by a predetermined angle.

In the right section of FIG. 7, the main shaft 21 is positioned on the same plane as the plane, on which the central axis Xt of the cylindrical workpiece 4 is located, and which is parallel with the base BS. The main shaft 21 is placed on approximately the same axis as the forming target central axis Xe of the end portion of the cylindrical workpiece 4 to be opposite to the cylindrical workpiece 4, and mounted on the case 20 through bearings 20*a*, 20*b* to be rotated about the central axis Xr. The main shaft 21 is a hollow cylindrical member, in which a cylindrical cam shaft 23 is received, and which is connected to a changing speed mechanism 50 as described later. Through a hollow portion of the cam shaft 23, a connecting rod 41 of the mandrel 40 is mounted to be movable in the axial direction of the cam shaft 23, independently from the main shaft 2. The mandrel 40 is formed to be fitted into the inner shape of the open end portion of the cylindrical workpiece 4. The connecting rod 41 is connected at its end to a cylinder 42 for driving it to move back and forth, and the cylinder 42 is mounted on the base BS through a bracket 1*c*. The main shaft 21 is connected through a gear train 22*a* to a pulley 22*b*, which is further connected to a rotating device such as a motor (not shown) through a belt (not shown), so as to rotate the main shaft 21. A flange 24 is fixed to a tip end of the main shaft 21, so that the flange 24 is rotated about the central axis Xr, together with the main shaft 21, when the latter is rotated. The cam shaft 23 is rotatably mounted on the flange 24. A cam plate 25 is fixed to a tip end portion of the cam shaft 23, and rotated about the central axis Xr together with the cam shaft 23. As shown in FIG. 9, the cam plate 25 is formed with three spiral guide grooves 25*a*, in which three guide pins 26 are disposed, respectively, to be moved in a radial direction in accordance with rotation of the cam plate 25. The guide pins 26 are mounted on three support members 27, respectively, and the roller 28 is rotatably mounted on each support member 27, as shown in FIG. 7. When the main shaft 21 is rotated, therefore, the roller 28 is revolved about the central axis Xr, and at the same time the support members 27 are moved in a radial direction along the guide grooves 25*a* in accordance with rotation of the cam plate 25, so that the roller 28 is moved toward and away from the central axis Xr of the cylindrical workpiece 4. That is, the spinning rollers 28 are activated while the cam plate 25 is being rotated, and they are revolved about the central axis Xr of the cylindrical workpiece 4, with the diameter of the revolutional locus changed.

The speed changing mechanism 50 connected to the main shaft 21 and the cam shaft 23 is the one employing a flexibly engaged driving system that includes a pair of outer rings 51, 52, which are engaged with the main shaft 21 and the cam shaft 23, respectively, and inner surfaces of which are formed with gears of the same number of teeth. The flexibly engaged driving system further includes a flexible gear wheel 53, which is formed with different number of teeth from the gears of the outer rings 51, 52, and which is engaged with the outer rings 51, 52, and includes a wave forming wheel 54, which is arranged to support the gear wheel 53 to be rotated, and which is arranged to engage with the gears of the outer rings 51, 52 at the two positions facing each other. The wave forming wheel 54 is rotated by a decelerating motor 55. The outer rings 51, 52 are mounted on support gears 56, 57, respectively. A driving gear 58 engaged with the support gear 56 is mounted on the main shaft 21, and a driven gear 59 engaged with the support gear 57 is mounted on the cam shaft 23. The flexibly engaged driving system is already known, and it provides a differential mechanism which causes a relative speed difference between the outer rings 51 and 52 in accordance with rotation of the main shaft 21. Accordingly, when the main shaft 21 is rotated, the cam shaft 23 is rotated by the differential rotation between the outer rings 51, 52, thereby to rotate the cam plate 25, so that each support member 27 and each roller 28 together therewith are moved in a radial direction toward and away from the central axis Xr of the main shaft 21. A plurality of rollers 28 are provided so as to reduce intermittent impacts, and it is ideal to provide three rollers 28 positioned with an equal distance spaced between the neighboring rollers, as in the present embodiment. Any course may be traced by the rollers 28 as long as the rollers 28 can be moved in a radial direction. As a further embodiment of the device for driving the rollers 28, may be employed a planetary gear mechanism (not shown herein), or other devices. The motors 9, 16, 31, 55 or the like and the actuators 18, 19*b*, 42 or the like are electrically connected to a controller (not shown), from which control signals are output to the motors and actuators to control them numerically.

In operation, referring to FIG. 7, when the upper clamp 17 of the clamp device 12 is lifted upward, the body portion of the cylindrical workpiece 4 is placed on the clamp face of the lower clamp 13, and set at the predetermined position where the one end portion of the cylindrical workpiece 4 is abutted on the stopper 19*a* of the positioning device 19. Then, the actuator 18 is driven, so that the upper clamp 17 is moved downward, and the body portion of the cylindrical workpiece 4 is clamped between the lower clamp 13 and upper clamp 17, and held not to be rotated. In this case, the cylindrical workpiece 4 is positioned such that the central axis Xe of the end portion of the cylindrical workpiece 4 is aligned with the central axis Xr of the main shaft 21, as shown in FIG. 8. Each roller 28 is retracted outside of the outer periphery of the cylindrical workpiece 4. Next, the case 20 is moved forward along the X-axis guide rail 5, i. e., leftward in FIGS. 6 and 7, and stopped at a position where each roller 28 is placed at the position away from the center of the shaft 31*a* of the clamp device 12 by a predetermined distance. Then, the mandrel 40 is moved forward to be placed in the open end portion of the cylindrical workpiece 4.

From the state as described above, the main shaft 21 is rotated about the central axis Xr, and each roller 28 is revolved about the central axis Xr, and the cam plate 25 is rotated through the speed changing mechanism 50, so that each roller 28 is moved radially toward the central axis Xr. At the same time, each roller 28 is moved rearward (rightward in FIGS. 7 and 8) along the X-axis guide rail 5. Accordingly, each roller 28 is rotated on its axis and revolved about the central axis Xr, in such a state pressed onto the outer surface of the end portion of the cylindrical workpiece 4, and moved radially toward the central axis Xr to perform the spinning process. Likewise, a plurality number of forming cycles are executed to form the reduced diameter portion 4*a*. Furthermore, the other end portion of the cylindrical workpiece 4 is formed by the spinning rollers 28 through the necking process, to provide the finished configuration of the tapered portion 4*b* and the bottle neck portion 4*c* as shown in FIG. 4. According to the present embodiment, the reversing operation of the cylindrical workpiece 4 can be made easily without stopping the rotation of the spinning rollers 28, so that the tact time can be reduced, and energy efficiency will be improved.

Figure 10:
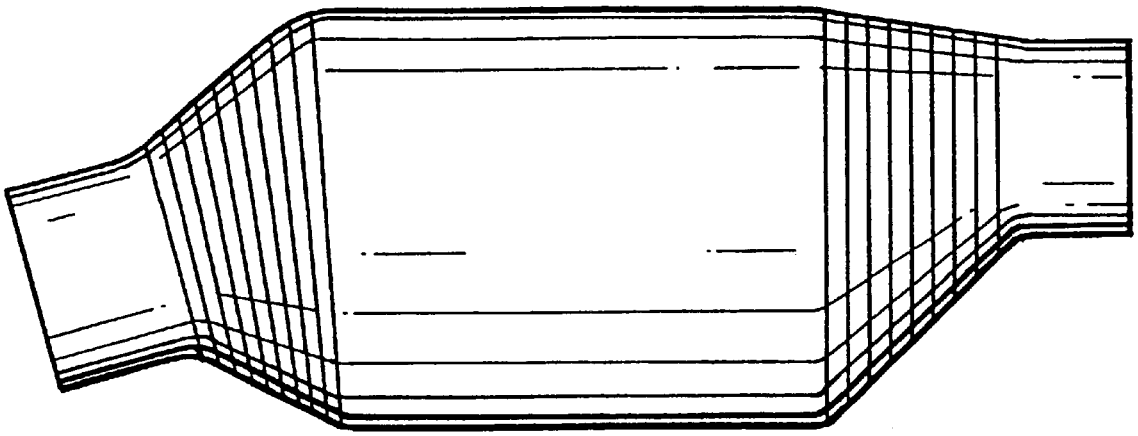
FIG. 10 is a front view of a finished catalytic converter according to an embodiment of the present invention.
Figure 11:
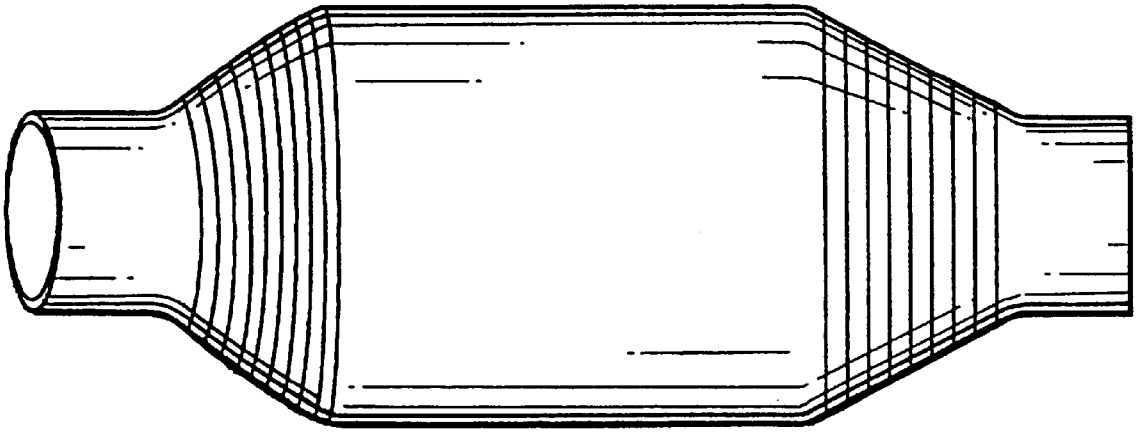
FIG. 11 is a plan view of a finished catalytic converter according to an embodiment of the present invention.

As a result, the bottle neck portion 4*c* is formed to be smoothly integrated with the body portion of the workpiece 4. For example, a finished catalytic converter as shown in FIGS. 10 and 11 which correspond to FIGS. 21 and 22 of the U.S. Design Pat. No. D452,694S, is produced. Thus, by controlling the spinning rollers 28 as desired, the end portions of the cylindrical workpiece 4 may be formed in a desired shape.

Figure 6:
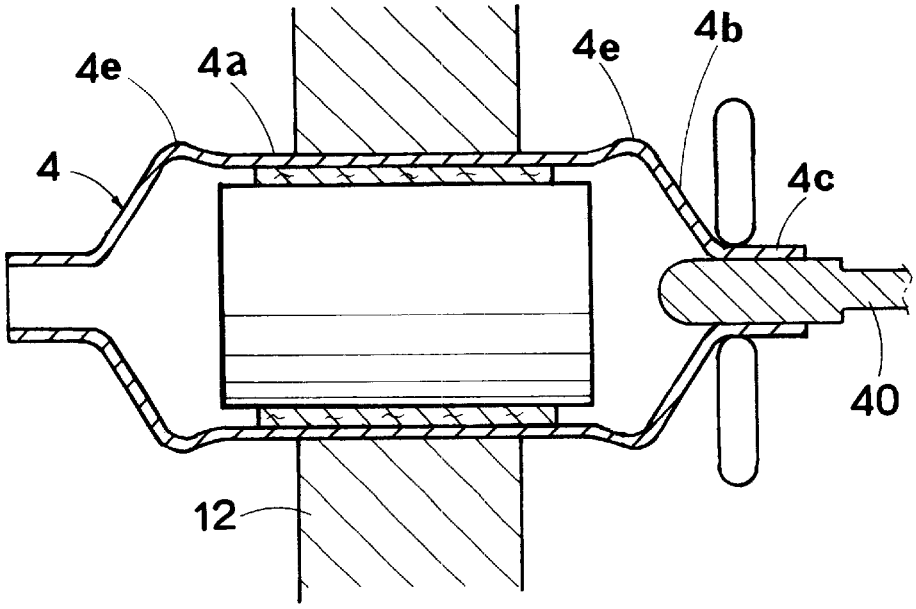
FIG. 6 is a side view sectioned in part of a catalytic converter, with the end potions of the cylindrical housing applied with a necking process by means of spinning rollers, according to a further embodiment of the present invention.

FIG. 6 relates to a further embodiment of the present invention, wherein after the reduced diameter portion 4*a* was formed on a body potion of the cylindrical workpiece 4, the necking process is performed in such a manner that the opposite end portions of the cylindrical workpiece 4 are formed to provide the tapered portion 4*b* and the bottle neck portion 4*c*, with stepped portions 4*e* formed between the reduced diameter portion 4*a* and the opposite end portions. Furthermore, the diameter of the stepped portion 4*e* may be reduced by the spinning rollers 28, to remove the stepped portions 4*e*. As described before, the bottle neck portion 4*c* may be formed on one end portion of the cylindrical workpiece 4 before the reduced diameter portion 4*a* is formed by the reducing diameter device (RD in FIG. 2). In this case, the spinning rollers 28 may be moved to reduce a diameter of a stepped portion, which may be formed on the cylindrical workpiece 4 after the diameter of the body portion was reduced.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method of producing a catalytic converter, comprising:

providing a shock absorbent member wrapped around an outer periphery of a catalyst substrate;

inserting the catalyst substrate and the shock absorbent member into a cylindrical workpiece;

reducing a diameter of a body portion of the cylindrical workpiece covering at least a portion of the shock absorbent member to hold the catalyst substrate in the cylindrical workpiece;

fixing the cylindrical workpiece to prevent the cylindrical workpiece from being rotated about a longitudinal axis thereof; and spinning at least an end portion of the cylindrical workpiece, by means of a plurality of spinning rollers, which are evenly positioned around the outer periphery of the end portion, and which are revolved about the axis of the end portion along a common circular locus, and moved in a radial direction of the end portion; and moving the plurality of spinning rollers in an axial direction of the end portion to reduce a diameter of the end portion along the axis thereof, and thereby form a neck portion of the cylindrical workpiece.

2. The method of claim 1, wherein the spinning process is made by three spinning rollers positioned with an equal distance spaced between neighboring rollers along the common circular locus.

3. The method of claim 1, wherein the spinning rollers are revolved about the axis of the end portion of the cylindrical workpiece positioned in a predetermined relationship with a longitudinal axis of the body portion of the cylindrical workpiece.

4. The method of claim 3, further comprising;

placing a mandrel in the end portion of the cylindrical workpiece when the neck portion is formed by the spinning rollers, the mandrel having a longitudinal axis positioned in a predetermined relationship with the longitudinal axis of the body portion of the cylindrical workpiece.

5. The method of claim 1, wherein the spinning rollers are moved to reduce a diameter of a stepped portion formed on the cylindrical workpiece after the diameter of the body portion was reduced, thereby to form the neck portion smoothly integrated with the body portion of the cylindrical workpiece.

6. The method of claim 1, wherein the spinning rollers are moved to reduce a diameter of a stepped portion formed between the body portion and the neck portion after the diameter of the body portion was reduced thereby to remove the stepped portion from the cylindrical workpiece.

7. A method of producing a catalytic converter, comprising:

providing a shock absorbent member wrapped around an outer periphery of a catalyst substrate;

inserting the catalyst substrate and the shock absorbent member into a cylindrical workpiece having one neck portion formed on one end portion of the cylindrical workpiece;

reducing a diameter of a body portion of the cylindrical workpiece covering at least a portion of the shock absorbent member to hold the catalyst substrate in the cylindrical workpiece;

fixing the cylindrical workpiece to prevent the cylindrical workpiece from being rotated about a longitudinal axis thereof;

spinning the other one end portion of the cylindrical workpiece, by means of the plurality of spinning rollers which are evenly positioned around the outer periphery of the other one end portion, and which are revolved about the axis of the other one end portion along a common circular locus, and moved in a radial direction of the other one end portion; and moving the plurality of spinning rollers in an axial direction of the other one end portion to reduce a diameter of the other one end portion along the axis thereof, and thereby form the other one neck portion of the cylindrical workpiece.

8. The method of claim 7, wherein the spinning process is made by three spinning rollers positioned with an equal distance spaced between neighboring rollers along the common circular locus.

9. The method of claim 7, wherein the spinning rollers are revolved about the axis of the other one end portion of the cylindrical workpiece positioned in a predetermined relationship with a longitudinal axis of the body portion of the cylindrical workpiece.

10. The method of claim 9, further comprising;

placing a mandrel in the other one end portion of the cylindrical workpiece when the neck portion is formed by the spinning rollers, the mandrel having a longitudinal axis positioned in a predetermined relationship with the longitudinal axis of the body portion of the cylindrical workpiece.

11. The method of claim 7, wherein the spinning rollers are moved to reduce a diameter of a stepped portion formed on the cylindrical workpiece after the diameter of the body portion was reduced, thereby to form the neck portion smoothly integrated with the body portion of the cylindrical workpiece.

12. The method of claim 7, wherein the spinning rollers are moved to reduce a diameter of at least a stepped portion formed between the body portion and the neck portions, after the diameter of the body portion and the diameter of the other one end portion were reduced, thereby to remove the stepped portion from the cylindrical workpiece.

13. The method of claim 7, wherein the necking portion of the one end portion is formed by means of a plurality of spinning rollers, which are evenly positioned around the outer periphery of the one end portion, and which are revolved about the axis of the one end portion along a common circular locus, and moved in a radial direction of the end portion, the plurality of spinning rollers being moved in an axial direction of the one end portion to reduce a diameter of the one end portion along the axis thereof.

* * * * *